US007602923B2

(12) United States Patent
Lee et al.

(10) Patent No.: US 7,602,923 B2
(45) Date of Patent: Oct. 13, 2009

(54) ELECTRO ACOUSTIC SYSTEM BUILT-IN TEST AND CALIBRATION METHOD

(75) Inventors: Yi-Bing Lee, Taipei (TW); Bo-Ren Bai, Chia-Yi Hsien (TW)

(73) Assignee: Fortemedia, Inc., Cupertino, CA (US)

( * ) Notice: Subject to any disclaimer, the term of this patent is extended or adjusted under 35 U.S.C. 154(b) by 953 days.

(21) Appl. No.: 11/029,367

(22) Filed: Jan. 6, 2005

(65) Prior Publication Data

US 2006/0039568 A1 Feb. 23, 2006

(30) Foreign Application Priority Data

Aug. 20, 2004 (TW) ..... 93125070 A

(51) Int. Cl.
*H04R 29/00* (2006.01)

(52) U.S. Cl. ..... 381/59; 381/96; 381/108; 381/58; 702/103

(58) Field of Classification Search ..... 381/59, 381/58, 96, 108, 104, 107, 95, 121; 702/117, 702/86, 103
See application file for complete search history.

(56) References Cited

U.S. PATENT DOCUMENTS 4,395,588 A * 7/1983 Franssen et al. ..... 381/96
5,771,297 A * 6/1998 Richardson ..... 381/57
6,704,424 B2 * 3/2004 Killion ..... 381/323
6,795,557 B1 * 9/2004 Makivirta et al. ..... 381/66
7,054,448 B2 * 5/2006 Yoshino et al. ..... 381/59

* cited by examiner

*Primary Examiner*—Vivian Chin
*Assistant Examiner*—Jason R Kurr
(74) *Attorney, Agent, or Firm*—Rosenberg, Klein & Lee

(57) ABSTRACT

An electro acoustic system built-in test and calibration method utilizes a built-in self-test module to send a test signal through a first circuit device to an audio transmitter, causing the audio transmitter to output a test signal, for enabling the test signal to be received by a audio receiver and then processed by a connected circuit device and converted into a feedback digital signal to the self-test module for comparing the linearity relative to the originally provided test signal so that the parameter values and conformity of circuit devices can be optimized subject to comparison result. The test and adjustment procedure is recycled for other parameter items, and a warning signal is produced when proper adjustment cannot be done. This built-in test and calibration module can be achieved in the form of an independent firmware code module, using the same DSP (digital signal processor) engine that drives the system for the self test purpose, in so doing, the function of self test can be called along the production line, in use, throughout the service life of the product, and virtually without any additional cost.

9 Claims, 2 Drawing Sheets

ELECTRO ACOUSTIC SYSTEM BUILT-IN TEST AND CALIBRATION METHOD

BACKGROUND OF THE INVENTION

1. Field of the Invention

The present invention relates to an electro acoustic system and more particularly, to the built-in test and calibration method of such system, which enables the electro acoustic system to be self-tested and corrected at any place with ease.

2. Description of the Prior Art

With the development of various communication technologies, communication devices such as telephone have become part of our everyday life. Because regular home telephones are cheap, people usually buy a new one to replace the failed units. However, if one expensive communication device, for example, conference station has a communication problem or noises, the maintenance fee is very high, and the related examination apparatus is also expensive. It is a heavy cost burden to the user either to repair the conference station by oneself or to send the conference station to the distributor for repair.

According to conventional techniques, the internal circuit of an expensive communication device must be tested during the semi-finished stage of the product, and the product is assembled and packed after test. However, some conditions such as signal interference and system instability may occur during assembly process or after a long period of use due to ageing or variation of parts and circuits. In this case, an expensive external test apparatus shall be used, or the product shall be detached for internal circuit examination, thereby resulting in waste of cost and manpower.

Further, when the sampling test of one particular lot of products shows a high failure rate, the products of the whole lot must be wholly examined. It requires much time and labor to examine the products of the whole lot because of the accumulated man-hours and occupation of expensive test apparatus involved. In this case, the production line will be interrupted, and the manufacturing cost will be greatly increased.

Therefore, it is desirable to provide an electro acoustic system built-in test and calibration method that eliminates the aforesaid problems.

SUMMARY OF THE INVENTION

The present invention has been accomplished under the circumstances in view. It is one object of the present invention to provide an electro acoustic system built-in test and calibration method, which provides a self-test module to enable the manufacturer or user to examine the electro acoustic system on the production line or in use without the requirement of an external test apparatus and major rework on the mechanicals.

It is another object of the present invention to provide an electro acoustic system built-in test and calibration method, which enables the electro acoustic system to be self tested and corrected without disassembling the product, and also makes the system more tolerable to the variation of individual components, so that the manufacturing cost can be greatly reduced.

It is still another object of the present invention to provide an electro acoustic system built-in test and calibration method, which greatly improves the stability and performance .of the electro acoustic system and prolongs its service life.

To achieve these and other objects of the present invention, the electro acoustic system built-in test and calibration method utilizes a built-in self-test module to send a test signal through a first circuit device to an audio device such as a speaker, driving the audio device to emit a test signal, the test signal, in turn, will be picked up by a transceiver such as a microphone, and then processed by a connected circuit device and converted into a feedback digital signal to the self-test module for comparing relevant characteristics with the originally provided test signal so that the parameter values and conformity of circuit devices can be optimized subject to comparison result. The test and adjustment procedure is recycled for other parameter items. Therefore, the electro acoustic system can use the built-in self-test module for self test and calibration either on the production line or at home. A final objective is that, since most of the advance communication device such as a conference system, or feature phones, has built-in DSP (Digital Signal Process) as their main engine. Such component is a particularly powerful tool for generating test signals and analyzing the result. Hence this invention also has an objective that, the built-in self test and calibration module be embodied in the form of an independent firmware code running in the same DSP engine. In so doing, the test module consume little more than a few hundred lines of instructions only, so there is almost zero additional cost for the implementation, and since its an inherent part of the same DSP engine, it can be called into action while the product is still in the production line, and accompany the product throughout its service life.

DETAILED DESCRIPTION OF THE PREFERRED EMBODIMENT

The invention provides an electro acoustic system built-in test and calibration method. The electro acoustic system can be a one-to-one system of one speaker to one microphone as shown in FIG. 1, or one-to-multiple system of one speaker to multiple microphones as shown in FIG. 2.

Figure 1:
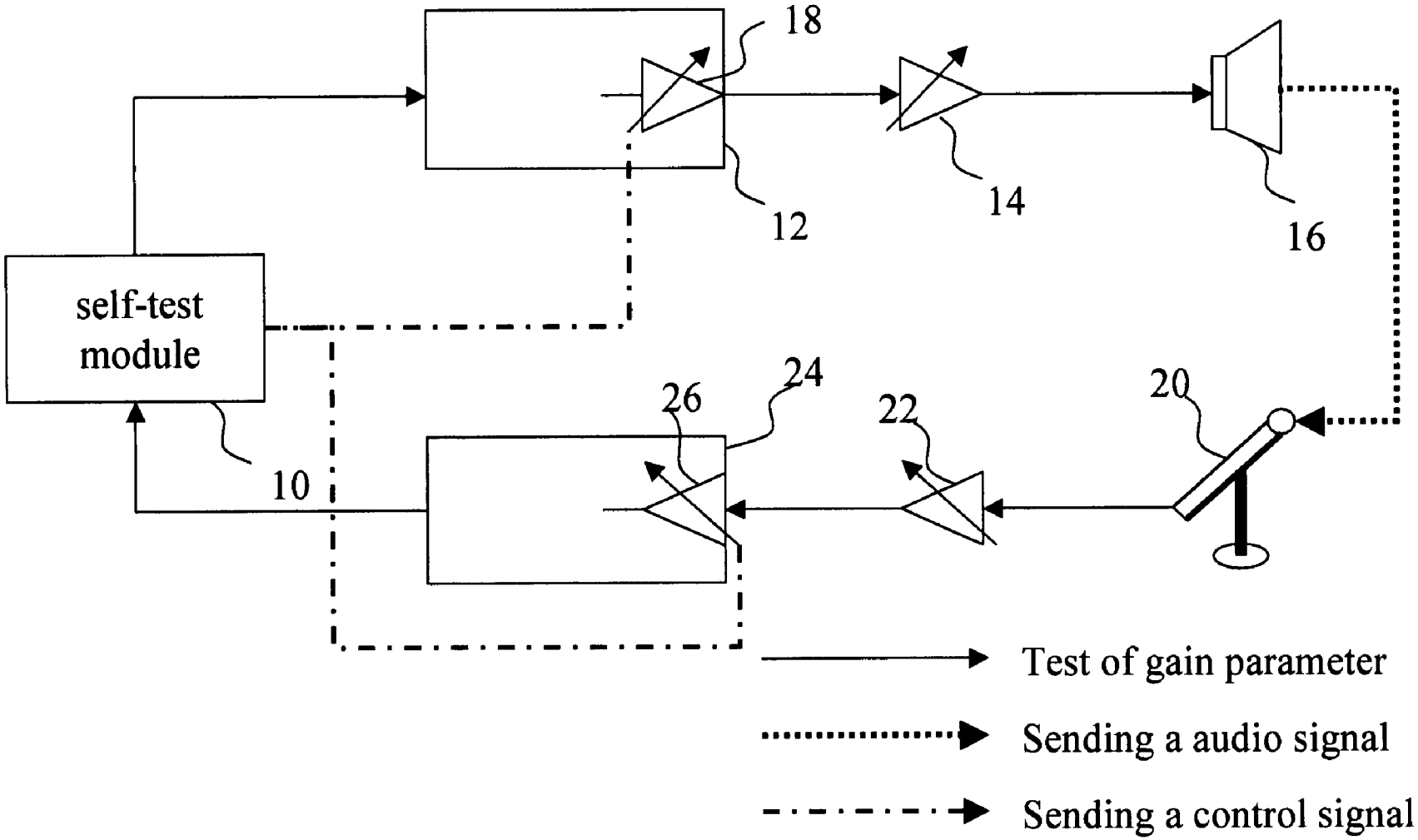
FIG. 1 is a block diagram showing a built-in test and calibration method in an electro acoustic system with one speaker to one microphone according to the present invention.
Figure 2:
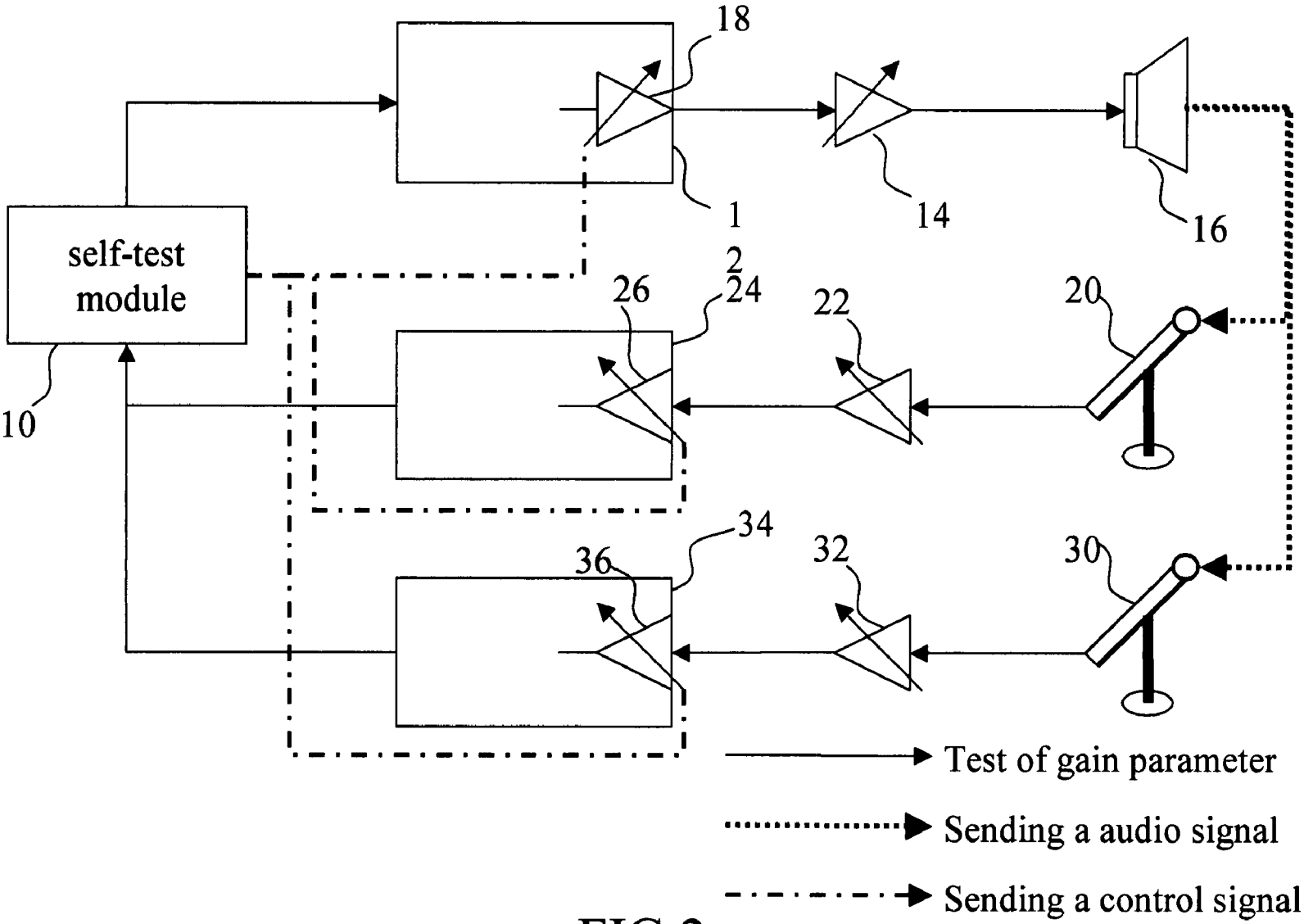
FIG. 2 is a block diagram showing a built-in test and calibration method in an electro acoustic system with one speaker to multiple microphones according to the present invention.

In the one-to-one system as shown in FIG. 1, the built-in self-test module, referenced by 10, tests may parameter items including Gain, Sensitivity, Phase delay, and Frequency response. In the one-to-multiple system as shown in FIG. 2, the built-in self-test module 10 tests many parameter items including Gain difference, Sensitivity difference, Phase delay difference, and Frequency response difference. Test of gain parameter keeps linear relationship of the circuits among the programmable gain amplifiers, assuring their parameter values to be within the accurate range. Test of frequency response controls stability of the speaker, the microphone(s) and the circuit.

In the one-to-one system as shown in FIG. 1, the built-in self-test module 10 is installed in a digital signal processor or integrated circuit. The self-test module 10 sends a gain parameter test signal to a first circuit device, for enabling the first PGA (programmable gain amplifier) 18 in the first Codec 12 of the first circuit device to process the gain parameter test signal. The first Codec 12 can also convert the test signal into an analog signal. For easy matching, the signal is sent to an amplifier 14 for amplification, and then the amplified signal is sent to an audio device, namely, the speaker 16, causing the speaker 16 to output a test audio signal, which is then received by an audio receiver, namely, the microphone 20. After reception of the analog signal of the test signal by the microphone 20, the analog signal is amplified by another amplifier 22 and then transmitted to a second PGA (programmable gain amplifier) 26 in a second Codec 24 of a second circuit device, which second Codec 24 converts the analog signal into a digital signal and sends the digital signal to the self-test module 10 for analysis on linearity or other related characteristics between the feedback digital signal and the original test signal. When the matching result exceeds a predetermined acceptable range, it will be necessary to adjust the parameter value of the first PGA (programmable gain amplifier) 18 or the second PGA (programmable gain amplifier) 26. The predetermined acceptable range is built in the digital signal processor or EEPROM (not shown) of the respective embodiment of the electro acoustic system.

When wishing to adjust the parameter value of the first PGA (programmable gain amplifier) 18 or the second PGA (programmable gain amplifier) 26 to the optimized parameter value, it is necessary to set up a predetermined median value for the second PGA (programmable gain amplifier) 26 and a predetermined maximum value for the first PGA (programmable gain amplifier) 18. The predetermined median value and maximum value are obtained from the predetermined range in the respective embodiment of the electro acoustic system. After setting of the predetermined median value and the predetermined maximum value, the self-test module 10 sends out a test signal to repeat the loop between the first Codec 12 and the second Codec 24, and uses a control signal to gradually lower the maximum value of the first PGA (programmable gain amplifier) 18 to the status that the linear relationship between the test signal sent by the self-test module 10 and the feedback digital signal obtained from the second Codec 24 is high enough, and the value at this status is the optimized parameter value for the first PGA (programmable gain amplifier) 18. If there is an overload in the loop between the first Codec 12 and the second Codec 24, the self-test module 10 will detect a nonlinear relationship between the original test signal and the feedback digital signal. Because the parameter value for the second PGA (programmable gain amplifier) 26 has been set to be the median value, a nonlinear relationship will occur only at the setting of the first PGA (programmable gain amplifier) 18.

After determination of the optimized parameter value for the first PGA (programmable gain amplifier) 18, find out the optimized parameter value for the second PGA (programmable gain amplifier) 26. At first, set the parameter value of the second PGA (programmable gain amplifier) 26 to be the maximum value. This maximum value is also built in the predetermined range in the respective embodiment of the electro acoustic system. Thereafter, the self-test module 10 sends out a test signal to repeat the loop between the first Codec 12 and the second Codec 24, and uses a control signal to gradually lower the maximum value to the status that the linear relationship between the test signal sent by the self-test module 10 and the feedback digital signal obtained from the second Codec 24 is high enough, and the value at this status is the optimized parameter value for the second PGA (programmable gain amplifier) 26. If there is an overload in the loop between the first Codec 12 and the second Codec 24, the self-test module 10 will detect a nonlinear relationship between the original test signal and the feedback digital signal. Because the parameter value for the first PGA (programmable gain amplifier) 18 already has the accurate parameter value, a nonlinear relationship will occur only at the setting of the second PGA (programmable gain amplifier) 26. The parameter values of the two PGAs 18 and 26 have a respective acceptable range recorded in the digital signal processor or EEPROM (not shown) of the respective embodiment of the electro acoustic system. If PGA minimum value<optimized value<PGA maximum value, send out the correcting message; furthermore, when the self-test module 10 is unable to adjust the parameter values of the first PGA (programmable gain amplifier) 18 and second PGA (programmable gain amplifier) 26 to the optimized status, it means that the internal circuit devices may be damaged. In this case, the self-test module 10 will output a warning signal to inform the user or examiner. When there is another parameter item to be tested after gain parameter test, the self-test module 10 will send a test signal again to repeat the aforesaid procedure until all circuit device parameters have been optimized.

When wishing to test Gain difference in the one-to-multiple system as shown in FIG. 2, the built-in self-test module 10 sends a gain difference test signal to a first circuit device, for enabling the first PGA (programmable gain amplifier) 18 in the first Codec 12 of the first circuit device to process the gain difference test signal. The first Codec 12 converts the test signal into an analog signal, which is ten amplified by an amplifier 14 and then sent to an audio device, namely, the speaker 16, causing the speaker 16 to output a test audio signal, which is then received by an audio receiver, namely, the microphone 20. After reception of the analog signal of the signal by the microphone 20, the analog signal is amplified by another amplifier 22 and then transmitted to a second PGA (programmable gain amplifier) 26 in a second Codec 24 of a second circuit device, which second Codec 24 converts the analog signal into a digital signal and sends the digital signal to the self-test module 10 for analysis on linear difference between the feedback digital signal and the original test signal. Thereafter, the parameter value of the first PGA (programmable gain amplifier) 18 and the parameter value of the second PGA (programmable gain amplifier) 26 are optimized subject to the first PGA (programmable gain amplifier) 18 and second PGA (programmable gain amplifier) 26 parameter value optimizing flow utilized in the afore the one-to-one system as shown in FIG. 1. When testing the gain parameters of the first and second PGA (programmable gain amplifier) 18 and 26, test the gain parameters of the first PGA (programmable gain amplifier) 18 and third PGA (programmable gain amplifier) 36. The test signal sent by the self-test module 10 for testing the gain parameters of the first PGA (programmable gain amplifier) 18 and third PGA (programmable gain amplifier) 36 passes through the first Codec 12 and the amplifier 14 to the speaker 16 for output, and the output signal from the speaker 16 is received by the second microphone 30. The signal received by the second microphone 30 is then amplified by an amplifier 32 and then transmitted to a third circuit device, which comprises a third Codec 34 having therein the third PGA (programmable gain amplifier) 36. The third Codec 34 converts the signal into a digital signal, and then feeds the digital signal back to the self-test module 10, for enabling the parameter values of the first PGA (programmable gain amplifier) 18 and third PGA (programmable gain amplifier) 36 to be optimized subject to the first PGA (programmable gain amplifier) 18 and second PGA (programmable gain amplifier) 26 parameter value optimizing flow utilized in the afore mentioned one-to-one system as shown in FIG. 1. These three PGAs (programmable gain amplifiers) 18, 26 and 36 have respective acceptable range recorded in the digital signal processor or EEPROM (not shown) of the respective embodiment of the electro acoustic system. If PGA minimum value<optimized parameter value<PGA maximum value, send out the correct message; on the contrary, send out a failure-warning signal. Thereafter, compare the second PGA (programmable gain amplifier) 26 and the third PGA (programmable gain amplifier) 36 at the microphone side to check the conformity of their parameter values with the received signal, and then adjust the conformity to the optimized status so as to complete the gain test and adjustment. The self-test module 10 can repeat the aforesaid procedure to test the other parameter items and to adjust the parameter values of the other parameter items to be optimized parameter values. If the feedback digital signal between the second PGA (programmable gain amplifier) 26 and the third PGA (programmable gain amplifier) 36 is not in conformity, it means the respective parameter values are not optimized and a further correction is necessary. If the desired conformity is not achievable after repeated adjustment, it means a severe difference between the second PGA (programmable gain amplifier) 26 and the third PGA (programmable gain amplifier) 36. At this time, the self-test module 10 will output a warning signal to inform the user or examiner.

As indicated above, the invention provides an electro acoustic system built-in test and calibration method, which utilizes a built-in self-test module to send a test signal through a first circuit device to a audio transmitter, causing the audio transmitter to output a test signal, for enabling the test signal to be received by a audio receiver and then processed by at least one circuit device and converted into a feedback digital signal to the self-test module for checking the linearity relative to the originally provided test signal. Every circuit device has a respective parameter value. The parameter value of every circuit device may be adjustable subject to comparison result of the self-test module. The self-test module compares the linear relationship between the parameter values of the circuit device so as to optimize the related the parameter value. The self-test module also matches the conformity between the parameter value and the received feedback signal, and then optimizes the conformity. After test and adjustment of one parameter item, the self-test module proceeds to the test and adjustment of the next parameter item. Thus, by means of the built-in self-test module, the internal circuit is well examined without the use of an external test apparatus or the need of unwrapping the product. Therefore, the invention greatly saves the manufacturing cost, improves the stability and performance of the electro acoustic system, and prolongs the service life of the electro acoustic system.

A prototype of electro acoustic system built-in test and calibration method has been constructed with the features of FIGS. 1 and 2. The light source assembly functions smoothly to provide all of the features discussed earlier.

Although particular embodiments of the invention have been described in detail for purposes of illustration, various modifications and enhancements may be made without departing from the spirit and scope of the invention.

What the invention claimed is:

1. An electro acoustic system built-in test and calibration, replaying and warning method, said electro acoustic system including an audio receiver with at least one microphone for generating an audio signal and an audio device with a speaker for playing a voice or warning sound, comprising the steps of:

(a) sending a test signal through a first circuit device to said audio device to produce a test audio signal; said test signal generated by a self test module for a calibration between said speaker and said at least one microphone;

(b) receiving the test audio signal by a plurality of audio receivers, for enabling the received test audio signal to be sent by the plurality of respective audio receivers to a plurality of respective second circuit devices for converting said test audio signal into a plurality of feedback digital signals for comparing a linearity difference between the test audio signal and the feedback digital signals by the self-test module; and (c) adjusting at least one parameter value of the first circuit device simultaneously relative to at least one parameter values of each of the plurality of second circuit devices being respectively connected to the audio receivers, and comparing the at least one parameter values of each of the plurality of second circuit devices with the corresponding received feedback digital signals and then determining an optimizing parameter of each of the plurality of second circuit devices such that the optimized parameters are within a predetermined range of each other;

(d) adjusting the at least one parameter value of the first circuit device when the linearity difference between the test signal and the feedback digital signal surpasses a predetermined value;

(e) driving the self-test module to send out a warning signal when the self-test module is unable to optimize the at least one parameter value of one of the first circuit device and at least one of the plurality of second circuit devices.

2. The electro acoustic system built-in test and calibration method as claimed in claim 1, wherein the self-test module is selected from the group consisting of an integrated circuit and a digital signal processor.

3. The electro acoustic system built-in test and calibration method as claimed in claim 1, wherein the at least one parameter value of the first circuit device and each of the plurality of second circuit devices includes gain difference, sensitivity difference, phase delay difference, and frequency response difference.

4. The electro acoustic system built-in test and calibration method as claimed in claim 1, wherein the first circuit device and each of the plurality of the second circuit devices comprise a Codec wherein the first circuit device is adapted to convert a digital signal into an analog signal and each of said plurality of second circuit devices is adapted to convert an analog signal into a digital signal.

5. The electro acoustic system built-in test and calibration method as claimed in claim 1, wherein when the linearity difference between the digital test signal and the feedback digital signal surpasses a predetermined value, it is necessary to adjust the at least one parameter value of the first circuit device and each of the plurality of second circuit devices.

6. The electro acoustic system built-in test and calibration method as claimed in claim 1, wherein step (d) is achieved by: setting up a predetermined median value for each of the plurality of second circuit devices, and a predetermined maximum value for the first circuit device, and then driving the self-test module to send out a digital test signal and to use a control signal to lower the maximum value until the linearity relationship between the test signal sent by the self-test module and the feedback digital signal reaches a value within a predetermined range, for enabling the value within said predetermined range to be regarded as the optimized parameter value for the first circuit device, and then setting the maximum value of each of the plurality of second circuit devices after determination of the optimized parameter value of the first circuit device, and then driving the self-test module to send a digital test signal and to use a control signal to lower the set maximum value of each of the plurality of second circuit devices until that the linearity difference between the test signal sent by the self-test module and the feedback digital signal reaches a predetermined range, for enabling the parameter in this range to be regarded as the optimized parameter value for the second circuit devices; said predetermined range stored in the module.

7. The electro acoustic system built-in test and calibration method as claimed in claim 6, wherein when an overload occurs between the first circuit device and each of the plurality of second circuit devices, the step of setting up the first circuit device and one of the plurality of second circuit devices causes the whole circuit to produce a nonlinear relationship as a result of said overload.

8. The electro acoustic system built-in test and calibration method as claimed in claim 6, wherein when the feedback digital signals between each of the plurality of second circuit devices are not within a predetermined range of each other, the settings of the parameter values of the second circuit devices are not optimized and a further setting is necessary; if the desired range is not achievable after repeated adjustment, it means a severe difference exists between each of the plurality of second circuit devices, and said self-test module will output a warning signal.

9. The electro acoustic system built-in test and calibration method as claimed in claim 1, wherein the self-test module sends different test signals to automatically circulate the test when testing multiple parameter items.

* * * * *